US008211383B2

(12) United States Patent
Nielsen et al.

(10) Patent No.: US 8,211,383 B2
(45) Date of Patent: Jul. 3, 2012

(54) HANDHELD AND/OR MOUNTABLE FLUID-EJECTION DEVICE HAVING TIP-EXTENSION ASSEMBLY AND/OR TUBINGS

(75) Inventors: Jeffrey A. Nielsen, Corvallis, OR (US); Blair M. Kent, Camas, WA (US); George Melchiorsen, Albany, OR (US); Paul E. Watts, Corvallis, OR (US); Paul Joseph Bruinsma, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1298 days.

(21) Appl. No.: 11/738,408

(22) Filed: Apr. 20, 2007

(65) Prior Publication Data

US 2008/0259148 A1 Oct. 23, 2008

(51) Int. Cl.
*B01L 3/00* (2006.01)

(52) U.S. Cl. ..... 422/500; 422/50; 422/501; 422/502; 347/40; 347/109

(58) Field of Classification Search ..... 422/500–511, 422/50; 347/40, 109
See application file for complete search history.

(56) References Cited

U.S. PATENT DOCUMENTS 5,853,251 A 12/1998 Imai
2003/0117456 A1* 6/2003 Silverbrook et al. ..... 347/40

FOREIGN PATENT DOCUMENTS

JP 09-277611 A 10/1997
JP 2000-177116 A 6/2000
WO 98/45205 A2 10/1998

OTHER PUBLICATIONS

International Search Report for International Application No. PCT/US2008/060361, filing date Apr. 15, 2008.

* cited by examiner

*Primary Examiner* — Jyoti Nagpaul

(57) ABSTRACT

A fluid-ejection device includes a handheld and/or mountable enclosure, a removable tip having a fluid-ejection mechanism, a first fitting extending from the enclosure and receptive to placement of the removable tip thereon, and a controller situated within the enclosure to cause the removable tip to eject the fluid. The fluid-ejection device may also include tip-extension assembly having an electrical cable connecting to the controller and having a second fitting receptive to placement of the removable tip thereon. The electrical cable permits the removable tip to be located substantially independently of the enclosure. The fluid-ejection device may further include tubings fluidically couplable with the removable tip through at least one of the first and second fittings to provide fluid to the removable tip and to regulate backpressure of the fluid within the removable tip.

5 Claims, 8 Drawing Sheets

HANDHELD AND/OR MOUNTABLE FLUID-EJECTION DEVICE HAVING TIP-EXTENSION ASSEMBLY AND/OR TUBINGS

BACKGROUND

Fluid-ejection devices are commonly used as inkjet printers to eject ink. However, research has been conducted to employ fluid-ejection devices for other applications as well. The small drops of fluid ejected by fluid-ejection devices can make them desirable as fuel injectors for motor vehicles, as pheromone ejectors for insect-control purposes, as frosting dispensers for cakes, as well as a variety of other purposes.

An issue with attempting to employ existing fluid-ejection devices, namely inkjet printers, for other applications is that developers have to purchase an inkjet printer and attempt to modify it for an alternative application. This process can be time-consuming, difficult, and expensive. As a result, potential utilization of fluid-ejection devices for non-printing purposes is inhibited.

DETAILED DESCRIPTION OF THE DRAWINGS

Fluid-Ejection Device and Removable Tip

Figure 1:
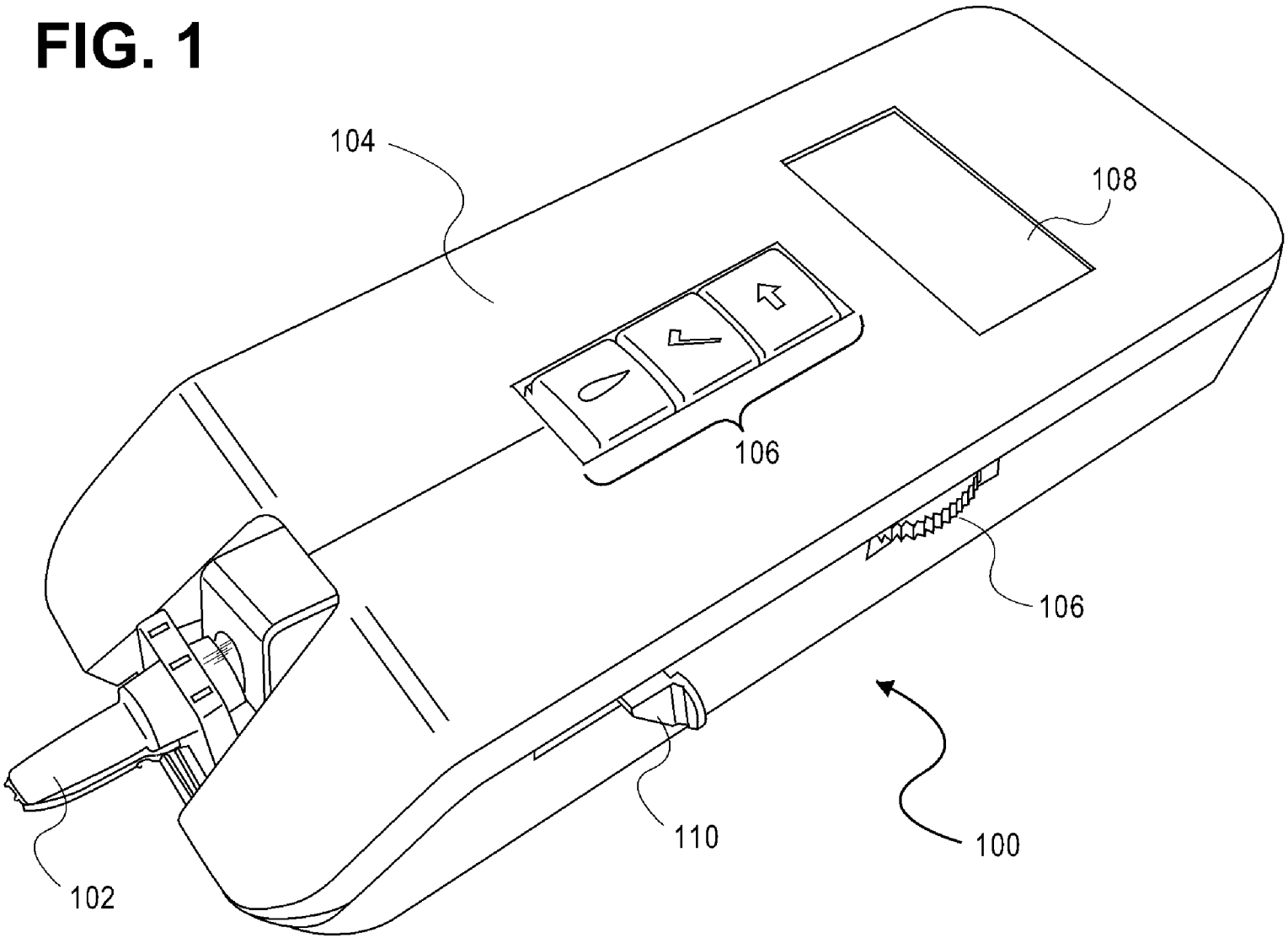
FIG. 1 is a diagram of a handheld and/or mountable fluid-ejection device on which a removable tip has been placed, according to an embodiment of the invention.

FIG. 1 shows a handheld and/or mountable fluid-ejection device 100 on which a removable tip 102 has been placed, according to an embodiment of the invention. The fluid-ejection device 100 is mountable in that it can be attached to a wall, bracket, or other object via screws, adhesive, or other mounting mechanisms. The fluid-ejection device 100 is handheld in that it can be easily held in place over a desired location by a user with just one hand while the device 100 is causing the tip 102 to eject one or more drops of fluid. The fluid-ejection device 100 is consistent with that described in more detail in the pending patent application entitled "Handheld and/or mountable fluid-ejection device receptive to tip containing fluid and fluid-ejection mechanism," filed on Sep. 14, 2006, and assigned Ser. No. 11/532,046, which is hereby incorporated by reference.

The fluid-ejection device 100 includes an enclosure 104, which is the part of the device 100 that is handheld and/or mountable. The enclosure 104 may be fabricated from plastic or another type of material. The fluid-ejection device 100 includes a user interface made up of a number of user-actuable controls 106 and a display 108. The controls 106 may be buttons and/or scroll wheels that are disposed within and extend through the enclosure 104, such that they are externally exposed as depicted in FIG. 1. The display 108 may be a liquid-crystal display (LCD), or another type of display, and is also disposed within and extends through the enclosure 104, such that it is externally exposed as well.

The fluid-ejection device 100 uses the display 108 to display information regarding the removable tip 102 placed on the device 100, among other types of information. The user is able to use the fluid-ejection device 100 to eject fluid from the tip 102 via the controls 106, with informational feedback provided on the display 108. The user can use the device 100 to eject fluid from the tip 102 on a stand-alone basis, without the fluid-ejection device 100 being connected to another device, such as a host device like a desktop or laptop computer, a digital camera, and so on. That is, the device 100 can be intended for use on a completely stand-alone basis, where the user controls fluid ejection from the tip 102 placed on the device 100 without having to connect the device 100 to a host device.

The fluid-ejection device 100 further includes an ejection control 110. User actuation of the ejection control 110 causes the removable tip 102 to be ejected from the fluid-ejection device 100, without the user having to directly pull or pry the tip 102 from the device 100. In this way, if the tip 102 contains a caustic or other type of fluid with which user contact is desirably not made it can be disposed of by simply positioning the fluid-ejection device 100 over a proper waste receptacle and ejecting the tip 102 from the device 100 into the waste receptacle.

The removable tip 102 placed on the fluid-ejection device 100 contains the fluid to be ejected and the actual fluid-ejection mechanism, such as an inkjet printhead. That is, the fluid-ejection device 100 in at least some embodiments does not store any supply of fluid, and does not perform the actual fluid ejection, but rather causes the tip 102 to eject the fluid from its fluid-ejection mechanism. In this way, the fluid-ejection device 100 can remain free of contact with the fluid ejected from the tip 102, even during ejection of the fluid by the tip 102.

As such, the fluid-ejection device 100 is not ever contaminated with fluid, and thus different removable tips containing different fluids and/or different types of fluid-ejection mechanisms can easily be switched off and on the device 100 to eject these different fluids in different ways, without having to clean the fluid-ejection device 100. In general, the fluid-ejection device 100 having the tip 102 placed thereon is able to cause ejection of fluid from the tip 102 in drops having volumes measurable in picoliters. For example, the drops may be between 2-300 picoliters, or even between 1-500 picoliters, in volume.

Figure 2:
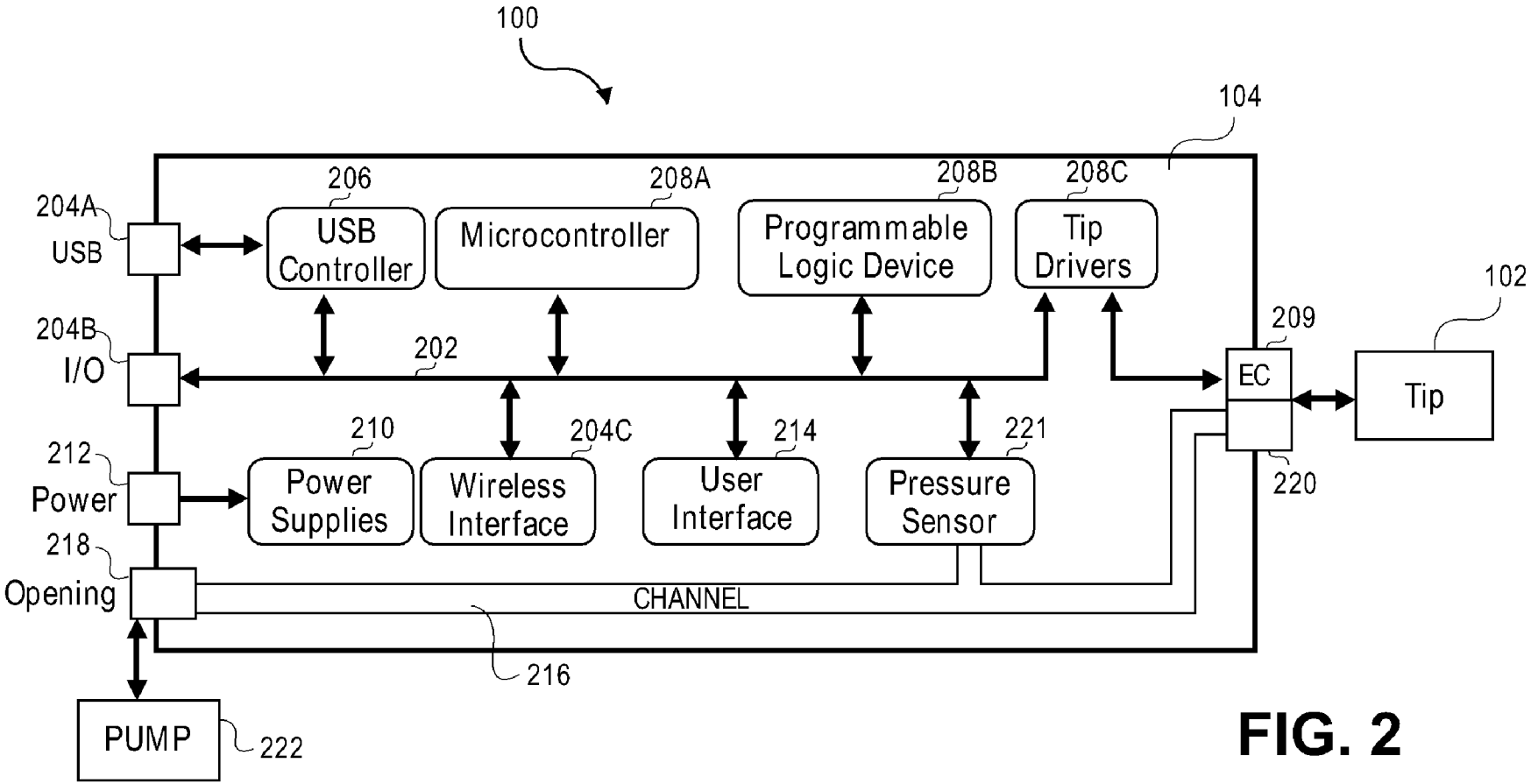
FIG. 2 is a functional diagram of the components of a fluid-ejection device on which a removable tip can be placed, according to an embodiment of the invention.

FIG. 2 shows a functional block diagram of the fluid-ejection device 100 depicting at least some of the constituent components of the device 100, according to an embodiment of the invention. The components of the fluid-ejection device 100 as described in relation to FIG. 2 are disposed at, reside within, and/or extend through the enclosure 104 of the device 100. The fluid-ejection device 100 may have other components, in addition to and/or in lieu of those depicted in FIG. 2, and the device 100 may not have all the components shown in FIG. 2 in some embodiments of the invention.

The fluid-ejection device 100 includes a communication bus 202. Indirectly or directly connected to the communication bus 202 are a number of interfaces 204A, 204B, and 204C, collectively referred to as the interfaces 204, of the fluid-ejection device 100. The interface 204A is a Universal Serial Bus (USB) interface, as known within the art, which connects to the communication bus 202 via a USB controller 206 of the fluid-ejection device 100. The USB controller 206 is a specialized hardware component to provide for USB communications. The interface 204B is a general input/output (I/O) interface, and may be a serial interface, such as an RS-232, RS-422, or RS-485 interface, a 1-Wire® interface, as known within the art, or another type of I/O interface. The interface 204C is a wireless interface, such as a Wi-Fi, 802.11a, 802.11b, 802.11g, 802.11n, and/or a Bluetooth wireless interface, or another type of wireless interface.

The interfaces 204 at the enclosure 104 enable the fluid-ejection device 100 to be communicatively coupled to another device to control ejection of fluid by the removable tip 102, and/or to receive information regarding the tip 102 placed on the device 100, among other types of information. The fluid-ejection device 100 can be employed on a stand-alone basis without being communicatively coupled to another device to cause the tip 102 to eject fluid. However, in another embodiment, the interfaces 204 enable other devices to communicatively couple to the fluid-ejection device so that these other devices effectively control ejection of fluid by the tip 102. These other devices may include computing devices, such as laptop or desktop computers, as well as more specialized types of devices.

The fluid-ejection device 100 also includes a number of controller components 208A, 208B, and 208C, collectively referred to as the controller components 208, situated within the enclosure 104, and communicatively coupled to the communication bus 202. The controller components 208 may constitute what is referred to herein as a controller. Generally, the controller is that which causes the removable tip 102 to eject fluid. More specifically, the controller component 208A is a general-purpose, readily available microcontroller that is employed to handle most slower-speed communications and functionality within the fluid-ejection device 100. By comparison, the controller component 208B is a programmable logic device (PLD) that is employed to handle faster-speed communications and functionality within the fluid-ejection device 100, as may be needed, for instance, to accommodate for the relatively fast triggering of the fluid-ejection mechanism of the tip 102 to eject fluid.

While the functionality of the controller component 208B can be subsumed into the controller component 208A, it is desirable to breakout the functionality of the controller component 208B separately, or otherwise the controller component 208A would have to be a more expensive, faster-speed microcontroller. Likewise, the functionality of the controller component 208A can be subsumed into the controller component 208B, but it is desirable to breakout the functionality of the controller component 208A separately. This is because the controller component 208B is a relatively more expensive PLD that would have to be even more expensive if it were to include the functionality of the controller component 208A.

The controller component 208A may include a table that describes the different types of removable tips that may be placed on the fluid-ejection device 100. Such a table includes entries corresponding to how much current, voltage, energy, or power to deliver to a given type of tip to cause it eject fluid, how long such current, voltage, energy or power should be delivered to result in a given type of tip to eject fluid, and so on. More generally, the entries of the table describe parameters as to how different types of tips are to be signaled so that they properly eject fluid under the control of the fluid-ejection device 100.

Furthermore, the controller component 208C can be considered as including tip drivers. These tip drivers may be a set of hardware devices or components for buffering signals passed to and from the removable tip 102 in relation to the fluid-ejection device 100. The fluid-ejection device 100 is electrically connected to the tip 102 via an electrical connector 209. More specifically, the communication bus 202 of the fluid-ejection device 100 is connected to the tip 102, through the controller component 208C, via the electrical connector 209. Communications signals from the fluid-ejection device 100 are transmitted to and received from the tip 102 via the electrical connector 209. Furthermore, power is provided to the fluid-ejection mechanism of the tip 102 from the fluid-ejection device 100 via the electrical connector 209.

The fluid-ejection device 100 is further depicted in FIG. 2 as including a power supply 210 within the enclosure 104, and that is connectable to a power interface 212 extending through the enclosure 104. The power supply 210 provides power to the components of the fluid-ejection device 100 as supplied by an external power source through a power cable connected to the power interface 212. Alternatively, the power supply 210 may be external to the enclosure 104 of the fluid-ejection device 100. Furthermore, the power supply 210 may in one embodiment include one or more rechargeable and/or non-rechargeable batteries, in addition to and/or in lieu of being connectable to an outside power source via a power cable connected to an external power source.

The fluid-ejection device 100 is also depicted in FIG. 2 as including a user interface component 214. The user interface component 214 resides or is disposed within the enclosure 104, and/or extends through the enclosure 104. The user interface component 214 includes the controls 106 and the display 108 of FIG. 1 that have been described, and is communicatively connected to the communication bus 202.

The fluid-ejection device 100 includes a gas channel 216 disposed or situated within the enclosure 104. The gas channel 216 may be externally exposed at an opening 218 within the enclosure 104 of the fluid-ejection device 100. At the other end, the gas channel 216 ends at a pneumatic fitting 220 to which the removable tip 102 is pneumatically connected. When the fluid is ejected from the tip 102, the fluid can be effectively replaced within the tip 102 with air (or another gas) supplied via the channel 216 from the opening 218, as can be appreciated by those of ordinary skill within the art. Otherwise, undesired negative air (or gas) pressure may build up within the tip 102 as its supply of fluid is ejected.

The pneumatic fitting 220 is more generally a fitting, where the fitting may or may not be pneumatic. The fitting 220 is generally the part of the fluid-ejection device 100 on which the removable tip 102 is placed. Where the fitting 220 is pneumatic, the removable tip 102 is pneumatically (i.e., fluidically) coupled to the fitting 220 and thus to the fluid-ejection device 100. Where the fitting 220 has no pneumatic purpose, it is just the part of the fluid-ejection device 100 on which the removable tip 102 is placed.

Generally, where the fluid-ejection device 100 is operated within a conventional environment, the gas supplied via the channel 216 is air from this environment. However, in other environments, the fluid-ejection device 100 may be operated such that the surrounding gas is other than air. For instance, such an environment may be constrained to an inert gas, such that the gas supplied via the channel 216 is this inert gas.

The gas channel 216 is fluidically, or pneumatically, connected to a pressure sensor 221 also disposed or situated within the enclosure 104 of the fluid-ejection device 100, and communicatively coupled to the communication bus 202. The pressure sensor 221 measures the air, or gas, pressure against the fluid within the removable tip 102 via the fluidic connection of the channel 216 with the tip 102 through the pneumatic fitting 220. The pressure sensor 221 can thus measure if there is positive air (or gas) pressure or negative air (or gas) pressure against the fluid within the tip 102.

The gas channel 216 may also be fluidically, or pneumatically, connected to a pump 222. The pump 222 is depicted as being external to the enclosure 104 of the fluid-ejection device 100, and fluidically, or pneumatically, coupled at the opening 218. Alternatively, the pump 222 may be internal to the enclosure 104 of the fluid-ejection device 100. In either case, the pump 222 may in one embodiment be considered part of the fluid-ejection device 100. The pump 222 can be employed to create positive pressure against the fluid contained within the removable tip 102, by pumping air (or another gas) to the tip 102 via the pneumatic fitting 220 through the channel 216. The pump 222 can also be employed to create negative pressure against the fluid contained within the tip 102, by pumping air (or another gas) from the tip 102 via the pneumatic fitting 220 through the channel 216.

Figure 3B:
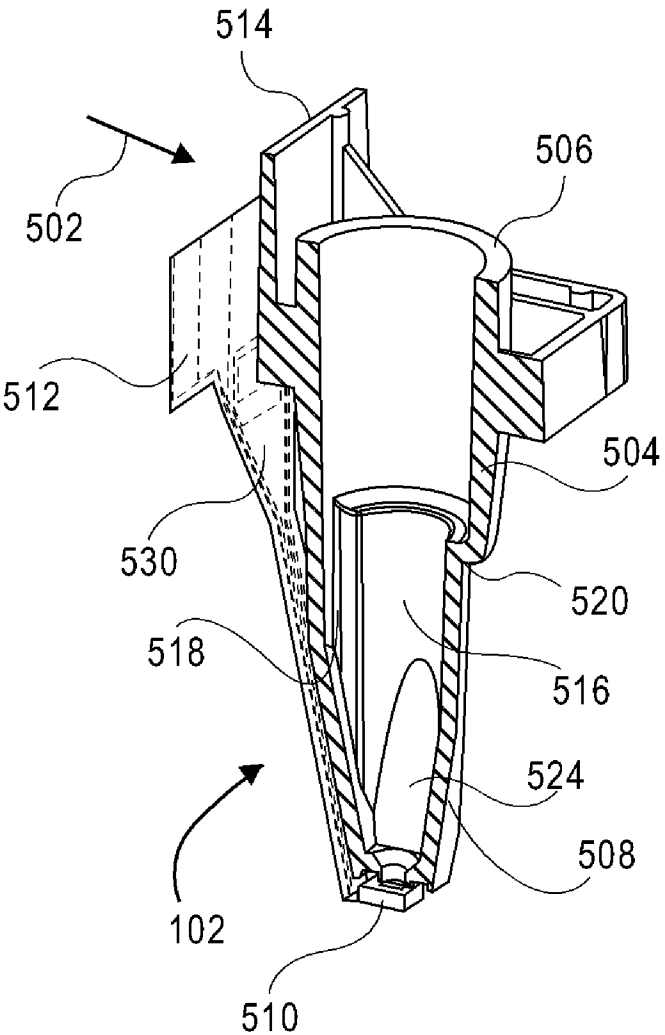
FIGS. 3A and 3B are diagrams of a removable tip that is to be placed on a fluid-ejection device, according to an embodiment of the invention.
Figure 3A:
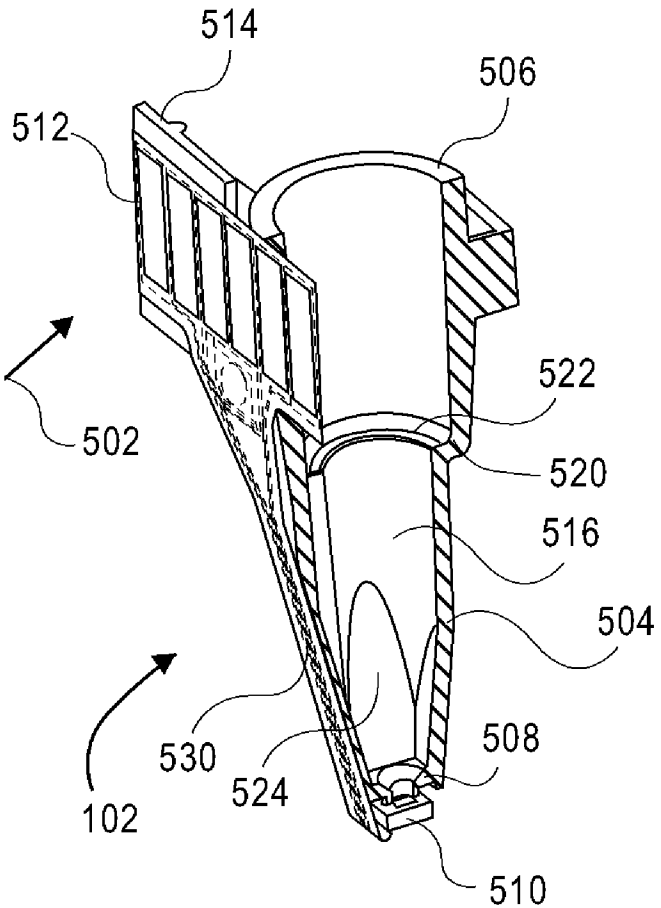

FIGS. 3A and 3B show partial cutaway views of the removable tip 102 for placement on the fluid-ejection device 100 in detail, according to an embodiment of the invention. Both FIGS. 3A and 3B are oriented in relation to the arrow 502, which is pointed towards a particular side of the tip 102. The tip 102 includes a substantially hollow body 504 to contain a supply of fluid. The body 504 includes a first end 506 and a second end 508. The body 504 of the tip 104 tapers from the first end 506 to the second end 508. The first end 506 corresponds to the pneumatic fitting 220 of the fluid-ejection device 100. The tip 102 is placed on the fluid-ejection device 100 such that the first end 506 of the tip 102 is placed on the pneumatic fitting 220 of the device 100.

The removable tip 102 further includes a fluid-ejection mechanism 510 situated or disposed at the second end 508 of the body 504 of the tip 102. The fluid-ejection mechanism 510 may be an inkjet printhead-like fluid-ejection mechanism, for instance, containing a smaller number of individual fluid-ejection nozzles, or orifices, than is typically found on an inkjet printhead. The fluid-ejection mechanism 510 ejects the fluid contained within the body 504 therefrom, outwards from the tip 102, such as via the nozzles or orifices thereof.

The removable tip 102 also includes an electrical connector 512. The electrical connector 512 is electrically connected to the fluid-ejection mechanism 510 of the tip 102 via a flexible circuit 530 running the between the former and the latter. The electrical connector 512 corresponds to the electrical connector 209 of the fluid-ejection device 100. Thus, the electrical connector 512 electrically couples to the electrical connector 209, so that the fluid-ejection device 100 is able to control ejection of the fluid contained within the tip 102 by the fluid-ejection mechanism 510. The electrical connector 512 is mounted on a flat tab 514 of the tip 102 that is at least substantially parallel to a centerline of the body 504.

The body 504 of the removable tip 102 includes a primary channel 516 between the first end 506 and the second end 508. The primary channel 516 is the primary manner by which fluid introduced at the first end 506 of the body 504 is delivered to the fluid-ejection mechanism 510 at the second end 508 of the body 504, such as by gravity. The body 504 also includes a secondary channel 518, called out only in FIG. 3B, between the first end 506 and the second end 508. The secondary channel 518 may be a secondary manner by which fluid introduced at the first end 506 is delivered to the fluid-ejection mechanism 510 at the second end 506. The secondary channel 518 is smaller than the primary channel 516, and is located to a side of the primary channel 516.

Furthermore, the secondary channel 518 within the body 504 of the removable tip 102 promotes the escaping of trapped gas, such as air, during delivery of the fluid to the fluid-ejection mechanism 510 at the second end 508 of the body 504. That is, while the fluid is moving within the body 504 from the first end 506 to the fluid-ejection mechanism 510 at the second end 508, air or other gas can become trapped, which can result in undesired bubbles within the fluid. The presence of the secondary channel 518 substantially alleviates this trapped gas, by providing a route by which such undesired bubbles can escape. Trapped gas is undesirable because it can result in a pocket of gas at the fluid-ejection mechanism 510, such that the fluid-ejection mechanism 510 can be starved of fluid to eject therefrom, even though there is fluid contained within the body 504 itself.

Tip-Extension Assembly

In some situations, it may be desirable to locate or place the removable tip 102 substantially independently of the enclosure 104 of the fluid-ejection device 100. For example, fluid may be desired to be ejected in a relatively tight space in which the fluid-ejection device 100 itself cannot fit. As another example, fluid may be desired to be ejected from a number of tips at the same location. In this scenario, a corresponding number of fluid-ejection devices may not be able to placed so that their tips are able to eject fluid at the same location.

Figure 4A:
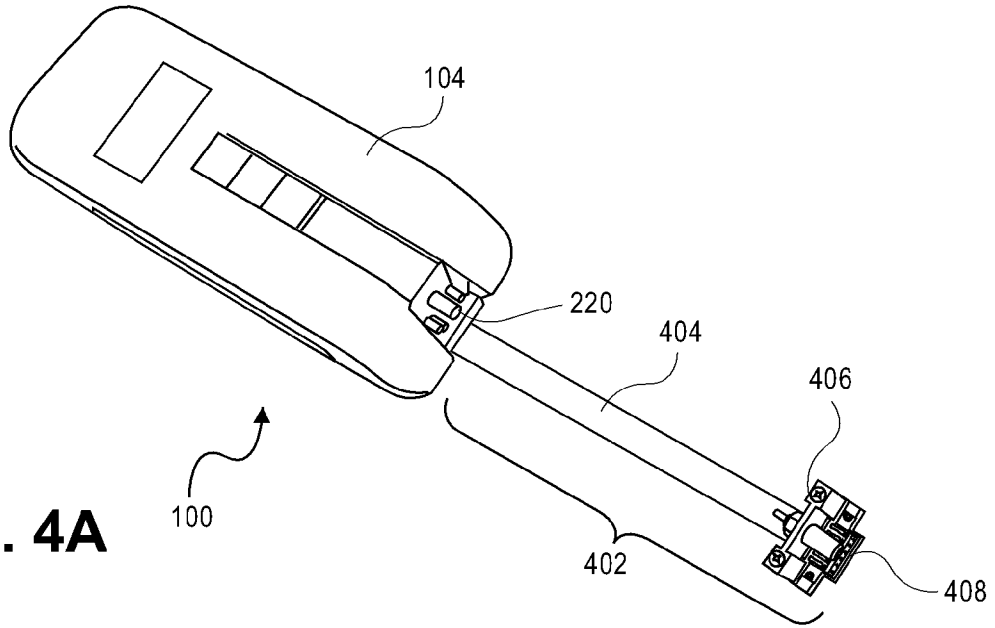
FIGS. 4A, 4B, and 4C are diagrams of a removable tip-extension assembly, according to an embodiment of the invention.
Figure 4C:
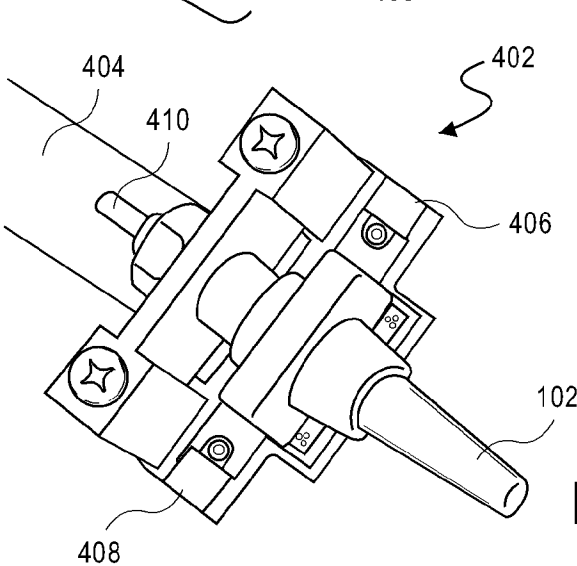
Figure 4B:
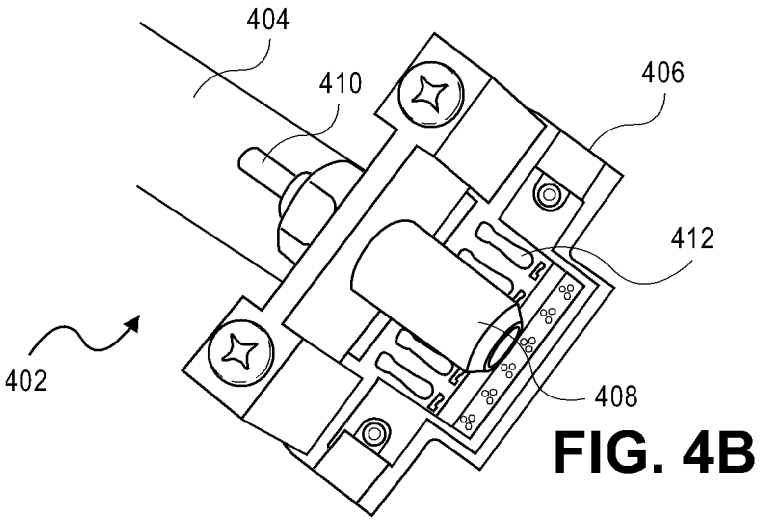

FIGS. 4A, 4B, and 4C show a tip-extension assembly 400, according to an embodiment of the invention. The tip-extension assembly 400 includes an electrical cable 404 that connects a substrate 406 of the assembly 400 to the enclosure 104 of the fluid-ejection device 100. In one embodiment, the substrate 406 services to isolate any circuitry of the assembly 400 from any conductive surface on or to which the assembly 400 may be attached. A pneumatic fitting 408 of the assembly 400 is mounted or disposed on the substrate 406. The pneumatic fitting 408 can be the same type of pneumatic fitting as the pneumatic fitting 220 of the fluid-ejection device 100 itself. The pneumatic fitting 408 of the assembly 400 can have a back port 410 that is to be fluidically connected to the pneumatic fitting 220 of the fluid-ejection device 100 via a tubing, where such a tubing is not particularly shown in FIGS. 4A-4C.

As with the pneumatic fitting 220 of the fluid-ejection device 100, the pneumatic fitting 408 of the assembly 400 is more generally a fitting, where the fitting may or may not be pneumatic. The fitting 408 is generally the part of the assembly 400 on which the removable tip 102 is placed. Where the fitting 408 is pneumatic, the removable tip 102 is pneumatically (i.e., fluidically) coupled to the fitting 408 and thus to the assembly 400. Where the fitting 408 has no pneumatic purpose, it is just the part of the assembly 400 on which the removable tip 102 is placed.

The removable tip 102 is placed on the pneumatic fitting 408 of the tip-extension assembly 400, such that the electrical connector 512 of the tip 102 (not shown in FIGS. 4A-4C) mates with a corresponding electrical connector 412 of the tip-extension assembly 400 that is also mounted or disposed on the substrate 406. The removable tip 102 when placed on the pneumatic fitting 408 of the tip-extension assembly 400 is controlled no differently than if it were placed on the pneumatic fitting 220 of the fluid-ejection device 100. The electrical connector 512 of the tip 102 mates with the electrical connector 412 of the assembly 400, such that the electrical connector 412 is coupled to the cable 404, which is itself electrically coupled to the controller 208 of the fluid-ejection device 100.

Therefore, electrical control and power signals that would otherwise be communicated between the fluid-ejection device 100 and the removable tip 102 via its electrical connector 512 having mated with the electrical connector 209 of the device 100 are instead communicated between the device 100 and the removable 102 via the electrical cable 404. The fluid-ejection device 100 itself, for instance, may not be aware that the removable tip 102 has been placed on the tip-extension assembly 402 instead of on the device 100. The tip-extension assembly 402 serves to extend the location of the removable tip 102 away from the location of the fluid-ejection device 100.

As such, the electrical cables 404, and any tubing fluidically connecting the back port 410 of the tip-extension assembly 402 to the pneumatic fitting 220 of the fluid-ejection device 100, permit the removable tip 102 to be located substantially independently of the enclosure 104 of the fluid-ejection device 100. Independent placement of the removable tip 102 relative to the fluid-ejection device 100 may be limited just by the size of the tip-extension assembly 402 itself, the length and/or flexibility of the electrical cable 404, and/or the length and/or flexibility of any tubing fluidically connecting the back port 410 to the device 100. The length of the electrical cable 404 and of any tubing fluidically connecting the back port 410 to the fluid-ejection device 100 may be six inches or longer in one embodiment.

Figure 5B:
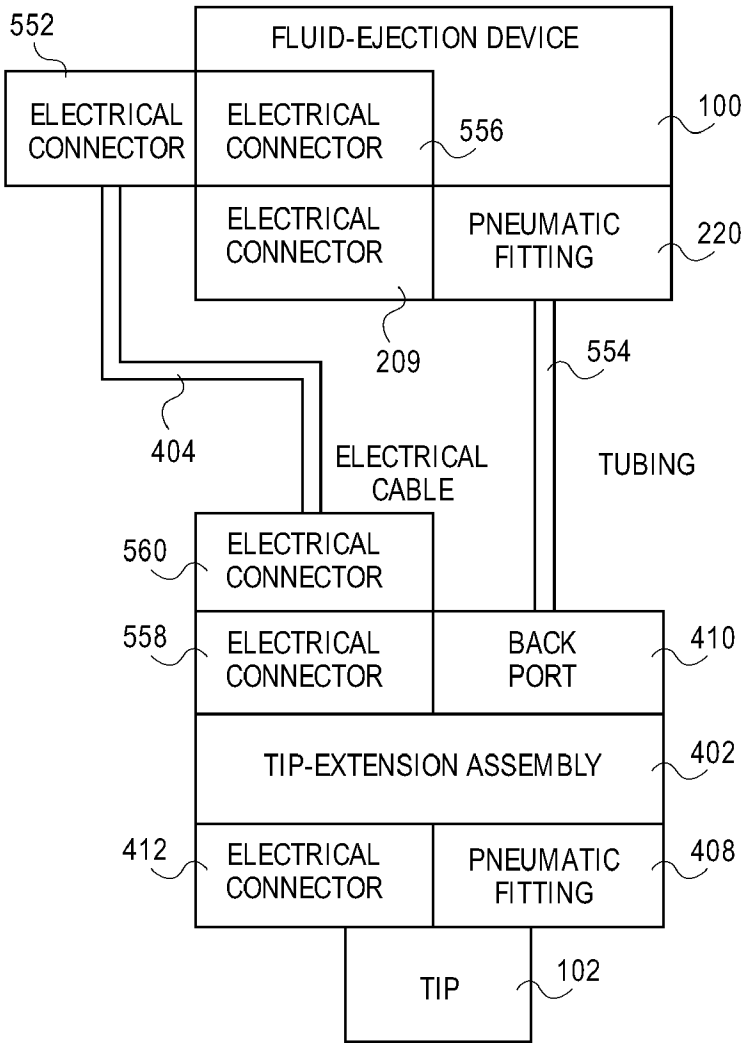
FIGS. 5A and 5B are block diagrams showing how a tip-extension assembly can be connected to a fluid-ejection device, according to varying embodiments of the invention.
Figure 5A:
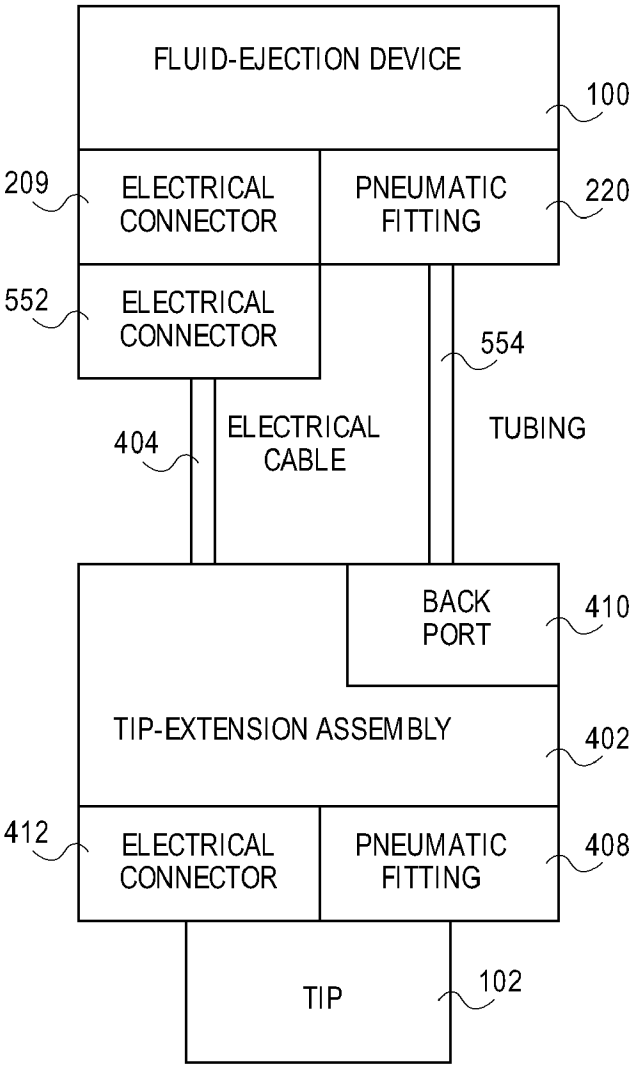

FIGS. 5A and 5B show block diagrams depicting how the tip-extension assembly 402 can be connected to the fluid-ejection device 100, according to varying embodiments of the invention. In both FIGS. 5A and 5B, the fluid-ejection device 100 includes the electrical connector 209 and the pneumatic fitting 220 to which the removable tip 102 is normally connected when the tip-extension assembly 402 is not being employed. The tip-extension assembly 402 includes the electrical connector 412 and the pneumatic fitting 408 to which the removable tip 102 is connected when the assembly 402 is being employed. The tip-extension assembly 402 also includes the back port 410 that has been described.

In FIG. 5A, the electrical cable 404 is permanently attached to the tip-extension assembly 402. The electrical cable 404 in this embodiment terminates in an electrical connector 502 that mates with the electrical connector 209 of the fluid-ejection device 100. That is, the electrical cable 404 is electrically coupled to the same electrical connector 209 which with the removable tip 102 would otherwise mate if the tip-extension assembly 402 were not being employed. A pneumatic tubing 554 also fluidically couples the back port 410 of the tip-extension assembly 402 to the pneumatic fitting 220 of the fluid-ejection device 100. The tubing 554 may be detachably connected to either or both of the back port 410 and the pneumatic fitting 220. The tubing 554 can in one embodiment be terminated in a fluidic connector that is disposed on a same substrate or housing as the electrical connector 552 is.

In FIG. 5B, the electrical cable 404 is detachably connected to the tip-extension assembly 402, via an electrical connector 560 that terminates the cable 404 mating with an electrical connector 558 of the tip-extension assembly 402. Furthermore, in the embodiment of FIG. 5B, the electrical connector 552 that terminates the other end of the electrical cable 404 is mated with an electrical connector 556 of the fluid-ejection device 100 that is different than the electrical connector 209 of the device 100. That is, the electrical cable 404 is electrically connected to the electrical connector 556 that is different than the electrical connector 209 with which the removable tip 102 would otherwise mate if the tip-extension assembly 402 were not being employed. As in the embodiment of FIG. 5A, the pneumatic tubing 554 is detachably coupled between the tip-extension assembly 402 and the fluid-ejection device 100 in FIG. 5B, and fluidically couples the back port 410 of the former with the pneumatic fitting 220 of the latter.

Those of ordinary skill within the art can appreciate that other embodiments can employ selected aspects of the embodiments of FIGS. 5A and 5B in combination, as well as other types of connections between the tip-extension assembly 402 and the fluid-ejection device 100. For example, the electrical cable 404 may terminate in the electrical connector 560 for mating with the electrical connector 408 of the tip-extension assembly 402, as in FIG. 4B, but may terminate in the electrical connector 552 that mates with the electrical connector 209 of the fluid-ejection device 100, as in FIG. 5A. As another example, the pneumatic tubing 554 may be permanently attached to the tip-extension assembly 402, instead of being detachably connected to the back port 410. In such an embodiment, the back port 410 may not be present, such that the tubing 554 is directly fluidically coupled to the pneumatic fitting 408 on which the tip 102 is placed.

Figure 6B:
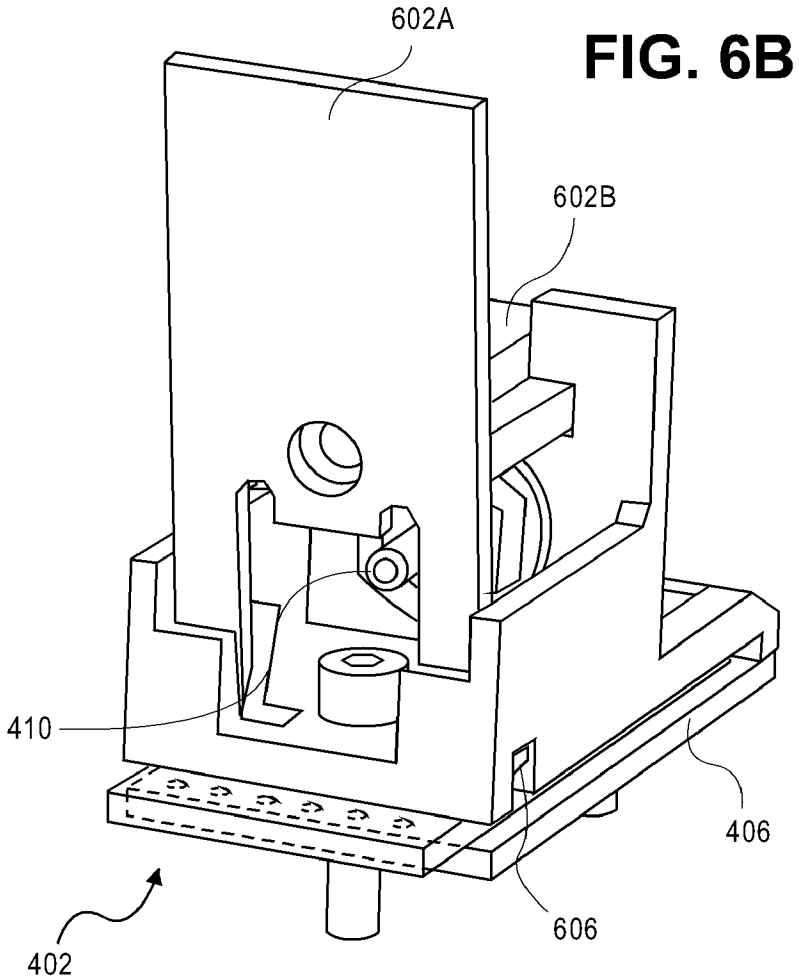
FIGS. 6A and 6B are diagrams of a removable tip-extension assembly, according to another embodiment of the invention.
Figure 6A:
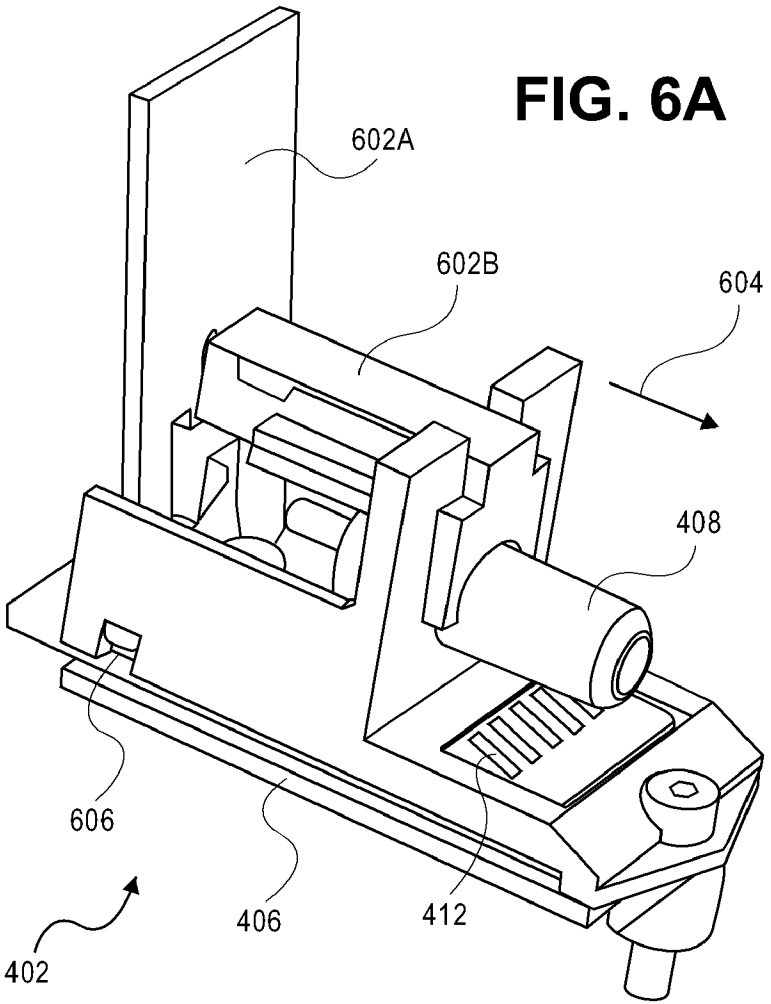

FIGS. 6A and 6B show the tip-extension assembly 402, sans the electrical cable 404 and the pneumatic tubing 554, according to another embodiment of the invention. As has been described, the tip-extension assembly 402 includes the substrate 406 on which the pneumatic fitting 408, the back port 410, and the electrical connector 412 are indirectly or directly disposed or mounted. The electrical cable 404 and/or the pneumatic tubing 554 may also be directly or indirectly disposed or mounted on the substrate 406 as well.

The tip-extension assembly 402 further includes an ejection mechanism 602 that is made up of an actuable lever 602A and a pushing member 602B. Actuating the lever 602A in the direction indicated by the arrow 604 causes the lever 602A to rotate about an axis 606. As such, the lever 602B moves the member 602B in the same direction indicated by the arrow 604. The member 602B comes into contact with the removable tip 102 that has been previously placed on the pneumatic fitting 408, forcing the removable tip 102 to be ejected from the pneumatic fitting 408. Those of ordinary skill within the art can appreciate that other types of ejection mechanism may be employed as well.

Continuous Fluid Supply to Removable Tip

The fluid-ejection device 100 and the removable tip 102 that have been described typically operate by aspirating fluid into the tip 102 so that the fluid can then be subsequently ejected from the tip 102 at desired locations and in desired volumes. Therefore, generally the amount of fluid that can be aspirated into the removable tip 102 at a given time is limited by the available space within the tip 102 to contain the fluid. While this is acceptable in many fluid-ejection environments, in other environments more fluid than can be contained within the tip 102 may be desired to be ejected. In such environments, additional fluid has to be periodically aspirated into the removable tip 102, which may prove cumbersome.

Figure 7:
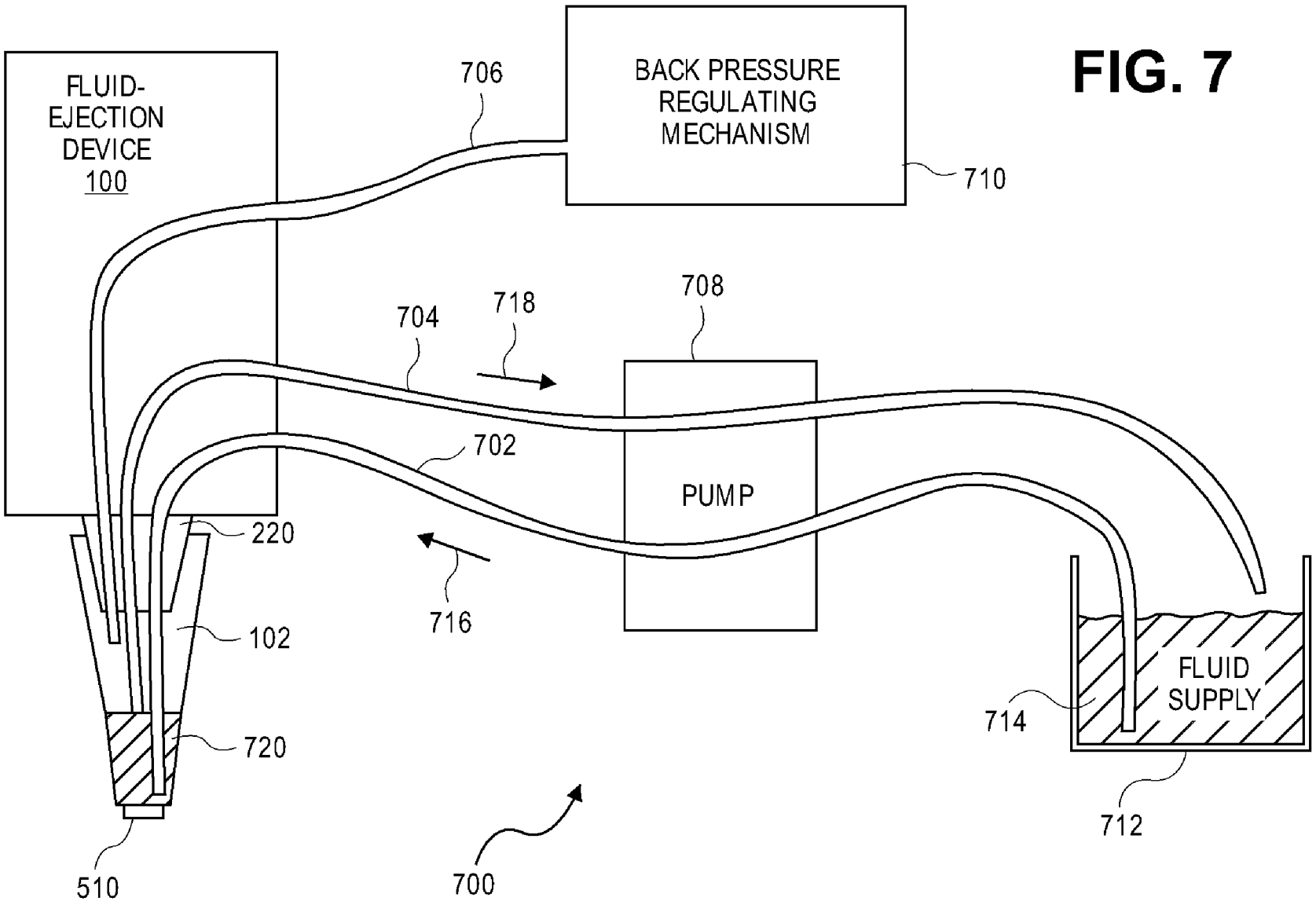
FIG. 7 is a diagram of a continuous fluid supply architecture for a fluid ejection-device on which a removable tip has been placed, according to an embodiment of the invention.

FIG. 7 shows a continuous fluid supply architecture 700 that can at least substantially continuously supply fluid to the removable tip 102 without the fluid having to be periodically aspirated into the tip 102, according to an embodiment of the invention. The removable tip 102 has been placed on the pneumatic fitting 220 of the fluid-ejection device 100 in FIG. 7, but may also be placed on the tip-extension assembly 402 that has been described in the preceding section of the detailed description. The removable tip 102 ejects fluid 720 contained therein from the fluid-ejection mechanism 510.

The fluid-ejection device 100 of FIG. 7 includes three tubings 702, 704, and 706 disposed through the pneumatic fitting 220 to reach the removable tip 102. The three tubings 702, 704, and 706 are fitted through the fluid-ejection device 100 so that extend through the pneumatic fitting 220 to reach the removable tip 102 placed on the fitting 220. The tubings 702 and 704 are fluidically coupled to a fluid supply 714 contained within a container 712 that is external to the removable tip 102 and the fluid-ejection device 100. More specifically, the tubing 704 ends above the fluid supply 714, whereas the tubing 702 ends within the fluid supply 714, such as towards or at the bottom of the container 712, at the level at which it is desired to stop drawing fluid from the fluid supply 714. The pump 708, which may be a peristaltic pump, circulates fluid from the fluid supply 714, so that the fluid 720 within the removable tip 102 is constantly replenished even as the fluid 720 is ejected from the fluid-ejection mechanism 510.

In particular, fluid is pumped from the fluid supply 714 to the removable tip 102 via the tubing 702 by the pump 708, as indicated by the arrow 716. By comparison, fluid is pumped from the removable tip 102 to the fluid supply 714 via the tubing 704 by the pump 708, as indicated by the arrow 718. By continually circulating fluid between the removable tip 102 and the fluid supply 714 within the container 712, the pump 708 ensures that the amount of fluid 720 within the tip 102 remains substantially constant and replenished while the fluid-ejection mechanism 510 is ejecting the fluid 720.

By comparison, the tubing 706 is fluidically coupled to a backpressure-regulating mechanism 710, such as a bubbler, an automatic backpressure controller, or another type of backpressure-regulating mechanism. The backpressure-regulating mechanism 710 monitors the gaseous pressure against the fluid 720 within the removable tip 102, and exerts positive or negative pressure against the fluid 720 as needed to maintain a desired level of backpressure against the fluid 720. That is, the backpressure-regulating mechanism 710 draws or adds gas from or to the removable tip 102, and/or allows gas to enter the tip 102, to maintain a substantially constant backpressure against the fluid 720 within the tip 102. (That is, gas may be added to the removable tip 102 to set the desired backpressure against the fluid 720, to offset any vacuum effects of the differential flow of between the flow of fluid and gas within the tubes 702 and 704. Such backpressure ensures that the fluid 720 contained within the removable tip 102 does not undesirably drool from the fluid-ejection mechanism 510 when the mechanism 510 is not currently ejecting fluid therefrom.

Thus, fluid from the fluid supply 714 is added to the fluid 102 within the removable tip 102 via the pump pumping the fluid through the tubing 702. The tubing 702 can be located at any desired position within the tip 102, such that, in one embodiment, so long as the tubing 702 is not in contact with the fluid 720. By comparison, the position of the tubing 704 within the tip 102 controls the height of the fluid level within the tip 102, and thus the volume of the fluid 720 within the tip 102. Therefore, a steady-state fluid volume can be set based on the height location of the tubing 704 within the tip 102. That is, ultimately, the fluid level within the tip 102 balances at a steady-state level at which the end of the tubing 704 within the tip 102 is at the fluid-air interface within the tip 102. This approach is more particularly described in U.S. Pat. No. 7,040,745, entitled "Recirculating Inkjet Printing System," and which issued on May 9, 2006.

Thus, the net flow rate into the fluid supply 714 within the container 712 is the difference between the flow rates of the tubes 704 and 702. In one embodiment, the tubing 704 has a greater flow rate than the tubing 702. As such, the net flow into the fluid supply 714 is positive. A vent may be included within the fluid supply 714 so that positive pressure does not build up within the container 712. At the tip 102, more fluid is therefore pulled out via the tubing 704 than supplied via the tubing 702. As a result of this negative net flow using the pump 708, air or other gas is drawn into the system from the backpressure-regulating mechanism 710 when the pump 708 is active. The tubing 704 is initially drawing gas from the tip 102 provided by the backpressure-regulating mechanism 710, until the fluid 720 reaches the level of the tubing 702 within the tip 102, at which point the tubing 704 draws fluid and gas from the system. The backpressure-regulating mechanism 710 therefore bleeds air or other gas into the system to maintain the pressure at a desired level.

Furthermore, the architecture 700 of FIG. 7 can be used to purge the fluid 720 from the removable tip 102. For instance, the original fluid 720 can be ejected from the tip 102, and then the pump 708 employed to pump in a different type of fluid while the original fluid 720 is being ejected from the tip 102. Ultimately, the new type of fluid replaces the original fluid 720 within the tip 102. Alternatively, the tubing 702 may be pinched, and the pump 708 run in reverse, to actively draw most of the fluid 720 from the tip 102. A different type of fluid may then be placed in the container 712, and the pump 708 again run to pump from the container 712 to the tip 102 via the tubing 702, and from the tip 102 to the container 712 via the tubing 704.

Figure 8:
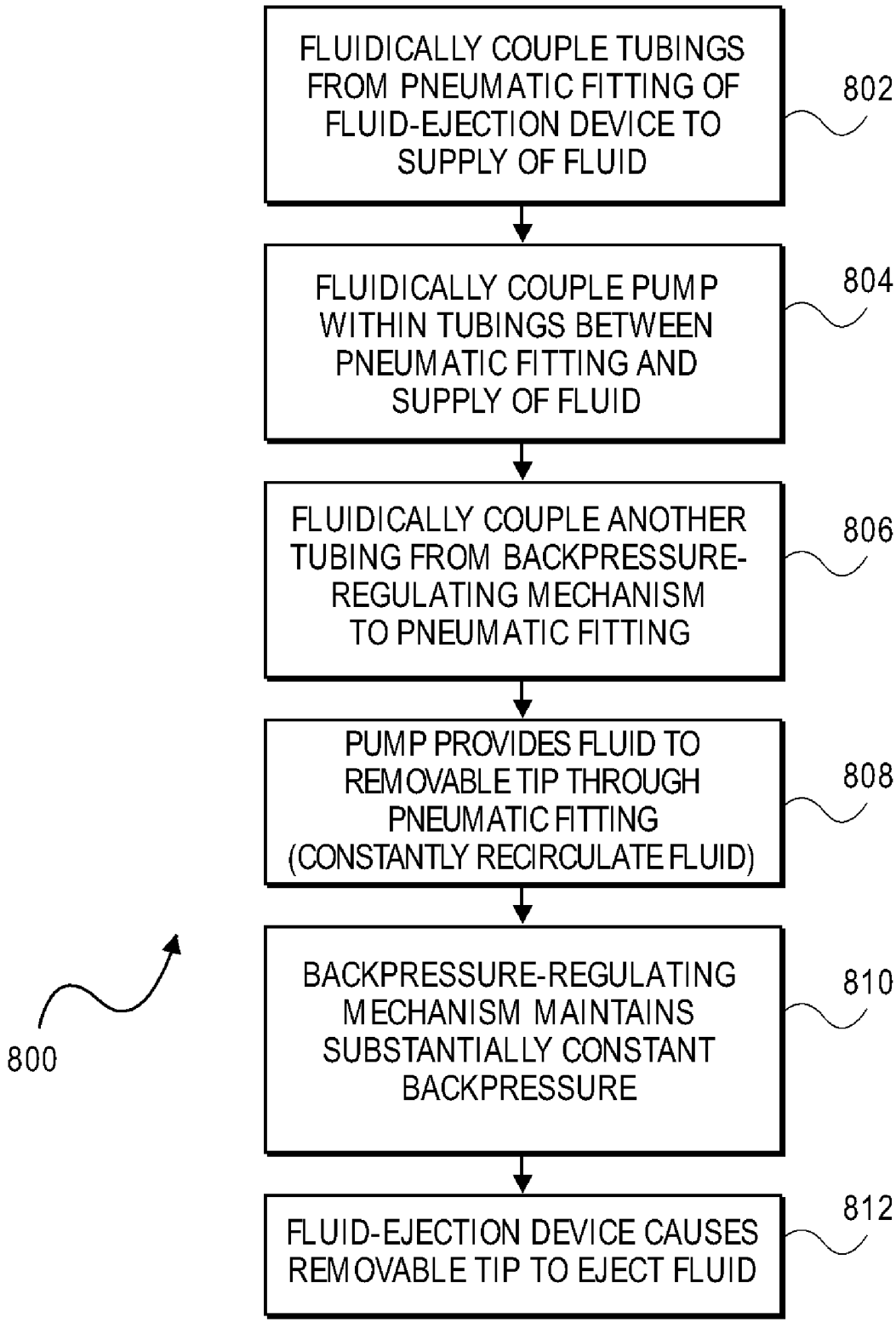
FIG. 8 is a flowchart of a method for realizing and using a continuous fluid supply architecture for a fluid ejection-device on which a removable tip has been placed, according to an embodiment of the invention.

FIG. 8 shows a method 800 for realizing and using the continuous fluid supply architecture 700 of FIG. 7, according to an embodiment of the invention. The tubings 702 and 704 are fluidically coupled from the pneumatic fitting 220 of the fluid-ejection device 100 to the fluid supply 714 within the external container 712 (802). The pump 708 is fluidically coupled within the tubings 702 and 704 between the pneumatic fitting 220 and the fluid supply 714 (804). The tubing 706 is fluidically coupled from the backpressure-regulating mechanism 710 to the pneumatic fitting 220 of the fluid-ejection device 100 (806).

The pump 708 provides fluid to the removable tip 102 through the pneumatic fitting 220 (808), where the removable tip 102 has been previously placed on the tip 102. For instance, the pump 708 pumps fluid through the tubing 702 to the removable tip 102, and pumps fluid through the tubing 704 from the tip 102, so that the fluid is continually circulated (and recirculated) between the removable tip 102 and the fluid supply 714. As such, a substantially constant amount of the fluid 720 is within the removable tip 102. The backpressure-regulating mechanism draws or adds gas, such as air, from or to the removable tip 102, through the tubing 706, or allows gas to enter the removable tip 102 as needed (810). As a result, a substantially constant backpressure against the fluid 720 within the tip 102 is maintained. The fluid-ejection device 100 then causes the removable tip 102 to eject fluid via the fluid-ejection mechanism 510 of the tip 102.

It is noted that whereas specific embodiments of the invention have been described herein, other embodiments of the invention can also be implemented that deviate or adapt from the specifically described embodiments. For example, two specific embodiments have been described, one in which a removable tip-extension assembly is employed to locate the removable tip substantially independently of the fluid-ejection device, and another in which a continuous fluid supply architecture is used to maintain a substantially constant supply of fluid within the removable tip. However, these two embodiments can be used together.

For instance, the tubings 702, 704, and 706 may be positioned through the pneumatic fitting 220 of the fluid-ejection device 100 and through the pneumatic fitting 408 of the tip-extension assembly 402. Alternatively, the tubings 702, 704, and 706 may be positioned just through the pneumatic fitting 408 of the tip-extension assembly 402, and not through the pneumatic fitting 220 of the fluid-ejection device 100. Either such embodiment realizes a substantially constant supply of fluid within the removable tip 102, while also allowing the tip 102 to be located substantially independent of the fluid-ejection device 100.

We claim:

1. A fluid-ejection device comprising:

a handheld and/or mountable enclosure;

a removable tip having a fluid-ejection mechanism;

a first fitting extending from the enclosure and receptive to placement of the removable tip thereon;

a controller situated within the enclosure to cause the removable tip to eject the fluid;

at least one of:

a tip-extension assembly having an electrical cable connecting to the controller and having a second fitting receptive to placement of the removable tip thereon, the electrical cable permitting the removable tip to be located substantially independently of the enclosure; and, a plurality of tubings fluidically couplable with the removable tip through at least one of the first and second fittings to provide fluid to the removable tip and to regulate backpressure of the fluid within the removable tip, wherein the electrical cable both is connected to the controller and permits the removable tip to be located substantiall independently of the enclosure: while the fluid-ejection device is being used to eject the fluid, while the fluid-ejection device is in an assembled state, and while an electrical connection is maintained between the controller and the tip-extension assembly.

2. The fluid-ejection device of claim 1, wherein the fluid-ejection device comprises the tip-extension assembly.

3. The fluid-ejection device of claim 2, wherein the fluid-ejection device further comprises an electrical connector extending from the enclosure and receptive to electrical coupling of an electrical connector of the removable tip upon placement of the removable tip on the first fitting, the controller causing the removable tip to eject fluid upon placement of the removable tip on the first fitting via electrical coupling of the electrical connectors of the fluid-ejection device and the removable tip.

4. The fluid-ejection device of claim 3, wherein the tip-extension assembly further has:

a first electrical connector terminating the electrical cable and mating to the electrical connector of the fluid-ejection device; and, a second electrical connector receptive to mate with the electrical connector of the removable tip upon placement of the removable tip on the second fitting, wherein the controller causes the removable tip to eject the fluid upon placement of the removable tip on the second fitting via electrical coupling of the electrical connector of the fluid-ejection device with the first electrical connector and via electrical coupling of the electrical connector of the removable tip with the second electrical connector.

5. The fluid-ejection device of claim 3, wherein:

the electrical connector of the fluid-ejection device is a first electrical connector of the fluid-ejection device, the fluid-ejection device further comprises a second electrical connector receptive to mating with the electrical cable of the tip-extension assembly, the tip-extension assembly has an electrical connector receptive to mating with the electrical connector of the removable tip upon placement of the removable tip on the second fitting, and the controller causes the removable tip to eject the fluid upon placement of the removable tip on the second fitting via electrical coupling of the second electrical connector of the fluid-ejection device with the electrical cable of the tip-extension assembly and via electrical coupling of the electrical connector of the removable tip with the electrical connector of the tip-extension assembly.

* * * * *

UNITED STATES PATENT AND TRADEMARK OFFICE

CERTIFICATE OF CORRECTION

PATENT NO. : 8,211,383 B2
APPLICATION NO. : 11/738408
DATED : July 3, 2012
INVENTOR(S) : Jeffrey A. Nielsen et al.

It is certified that error appears in the above-identified patent and that said Letters Patent is hereby corrected as shown below:

In column 11, lines 37-38, in Claim 1, delete “substantiall” and insert -- substantially --, therefor.

Signed and Sealed this
Eighth Day of January, 2013

David J. Kappos

David J. Kappos
*Director of the United States Patent and Trademark Office*